US006211854B1

(12) United States Patent
Fujiyoshi

(10) Patent No.: US 6,211,854 B1
(45) Date of Patent: Apr. 3, 2001

(54) DISPLAY APPARATUS AND DRIVING METHOD THEREFOR

(75) Inventor: Tatsumi Fujiyoshi, Miyagi-ken (JP)

(73) Assignee: Frontec Incorporated, Sendai (JP)

( * ) Notice: Subject to any disclaimer, the term of this patent is extended or adjusted under 35 U.S.C. 154(b) by 0 days.

(21) Appl. No.: 09/246,629

(22) Filed: Feb. 8, 1999

(30) Foreign Application Priority Data

Feb. 10, 1998 (JP) ..... 10-028825

(51) Int. Cl.[7] ..... G09G 5/34
(52) U.S. Cl. ..... 345/121; 345/123; 345/125
(58) Field of Search ..... 345/121, 438, 345/98, 123, 99, 124, 100, 125, 101, 136, 103, 104, 112, 114, 115, 113, 435, 90, 30, 127, 55, 87, 204, 173, 178; 348/790, 792, 739, 87

(56) References Cited

U.S. PATENT DOCUMENTS 5,119,084 * 6/1992 Kawamura et al. ..... 345/98
5,469,274 * 11/1995 Iwasaki et al. ..... 358/450
5,574,476 * 11/1996 Inoue et al. ..... 345/100
5,844,534 * 12/1998 Okumura et al. ..... 345/90
5,870,075 * 2/1999 Yamazaki et al. ..... 345/149
6,046,711 * 4/2000 Kouchi ..... 345/8

* cited by examiner

*Primary Examiner*—Matthew Luu
*Assistant Examiner*—Thu-Thao Havan
(74) *Attorney, Agent, or Firm*—Brinks Hofer Gilson & Lione

(57) ABSTRACT

A display apparatus allows size reduction without increasing manufacturing cost and can provide the greatest possible power saving effect by drive-method switching. The display apparatus has a moving-image/still-image determination circuit having an adder adding digital signals for one screen by receiving digital signals on a pixel basis of individual pixels constituting image signals for one screen, having a comparator comparing a result of addition of digital signals constituting image signals of an immediately-preceding screen and a result of addition of digital signals constituting image signals of the current screen, using a result of the comparison by the comparator 15 to determine the images to be moving images when the addition results are different from each other and to determine the images to be still images when the addition results are identical to each other, and outputting a determination signal according to the respective images.

4 Claims, 6 Drawing Sheets

DISPLAY APPARATUS AND DRIVING METHOD THEREFOR

BACKGROUND OF THE INVENTION

1. Field of the Invention

The present invention relates to a display apparatus and to a driving method for the display apparatus; more particularly, the invention relates to a moving-image/still-image determination circuit for switching the driving method between that for a moving image and that for a still image, particularly in a display apparatus (hereinafter may be referred to as an LCD) such as a lower power consumption type.

2. Description of the Related Art

Generally, there are two types of driving methods for display apparatuses. One is a sequential-scanning driving method (called a "progressive driving method") that sequentially scans all scanning lines in a frame. Another is a reduction driving method (called an "interlaced driving method") that separates the frame into plural fields and reduces the scanning lines when carrying out the scanning of the scanning lines in the field.

In a field of TFT-LCDs, lower power consumption is increasingly demanded. To satisfy such an increasing demand, use of the reduction driving method from among the two methods is effective. However, the display apparatus must display moving images and still images, and when the reduction method is used for such images, especially for the moving image, defective elements such as lags and tailings are caused. For this reason, the progressive (non-reduction) driving method must be used. Therefore, the two driving methods must be switched between that for the moving image and that for the still image. This requires use of a function that quickly determines whether an image to be displayed is a moving image or a still image.

FIG. 9 shows a drawing illustrative of a conventional moving-image/still-image determination method. As shown in the figure, a frame memory 1 and a comparator circuit 2 are arranged in a display apparatus to perform the moving-image/still-image determination. When the moving-image/still-image determination is performed, image signals for an immediately-preceding screen are stored in the frame memory 1 in digital signal form, and the digital signals corresponding to the image signals for the immediately-preceding screen, which are supplied from the frame memory 1, are compared to digital signals corresponding to current signals in the comparator circuit 2. In this case, all digital signals of pixels on the same position of the screen are compared. As a result, when any difference is found between the signals for the immediately-preceding screen and the current signals, the screens are determined by the comparator circuit 2 to be moving screens, whereas when all the signals for the immediately-preceding and the current signals match, the screens are determined by the comparator circuit 2 to be still images.

Conventional display apparatuses having the moving-image/still-image determination function, however, uses a frame memory having a large capacity sufficiently to store signals corresponding to all pixels of one screen. For example, for a VGA (640×480 pixels), a frame memory of about 1 megabyte is necessary. When the moving-image/still-image determination is performed in a configuration such as that described above and a frame memory of a large capacity is used, a larger configuration is necessary and higher cost is required for manufacture. Therefore, use of such a large frame memory increases manufacturing cost of the display apparatus and limits the possibility of size reduction.

Furthermore, such a 1-megabyte frame memory alone consumes 1.5 W of power, while power that can be saved by use of the reduction driving method for still images in a VGA display apparatus is about 0.5 W. Therefore, this power saving by use of the large frame invites converse effects.

SUMMARY OF THE INVENTION

To solve the foregoing problems, an object of the present invention is to provide a display apparatus and a driving method for the display apparatus that allows size reduction without increasing manufacturing cost and provides greatest possible power saving effects by drive-method switching.

To these ends, according to one aspect of the present invention, there is provided a display apparatus that comprises a plurality of scanning lines and signal lines which are arranged in a matrix form; a scanning-line driving circuit to drive the scanning lines; a signal-line driving circuit to drive the signal lines; a moving-image/still-image determination circuit that has an adding means to add digital signals of pixels constituting image signals for a screen by receiving the digital signals on a pixel basis, has a comparing means to compare a result of addition of image signals for a one screen, which has been provided by the adding means, to a result of addition of digital signals constituting image signals for another screen which is adjacent in time to the earlier-stated one screen, uses a result of comparison by the comparing means to determine individual images provided by the image signals and by the image signals for the earlier-stated one screen and later-stated another-screen to be moving images when the two addition results are different from each other and to determine the images to be still images when the two addition results are identical to each other, and outputs a determination signal corresponding to the moving image or the still image; and controls the scanning-line driving circuit and the signal-line driving circuit according to the determination signal.

In performing the moving-image/still-image determination by using digital signals of screens which are adjacent in time to each other, for example, image signals for the immediately-preceding screen and the current screen, conventionally, digital signals equivalent to the image signals have been directly compared; therefore, a frame memory of a larger capacity has been required to store the image signals corresponding to all the pixels for one screen.

In the present invention, however, the adding means receives, on a pixel basis, digital signals of individual pixels which constitute image signals for one screen, and the comparing means compares a result of addition of the image signals for the immediately-preceding screen to a result of addition of the current image signals.

Hereinbelow, a description will be given of a principle of the determination method to be performed by the moving-image/still-image determination circuit of the present invention.

As shown in FIGS. 8A and 8B, an example arrangement is considered. In this arrangement, each of the non-hatched pixels is allowed to assume a "0" digital data (1 bit) and each of hatched pixels is allowed to assume a "1" digital data (1 bit) on a display screen formed of 12 pixels 3 (4 horizontal pixels×3 vertical pixels). Suppose a rectangular pattern 4 of the hatched pixels (1s ) in a background of the non-hatched pixels (0s), as shown in FIG. 8A, moves down, as shown in FIG. 8B. In this case, the image signal data is represented by a bit string of "000000110011", as arrayed from the upper left toward the lower right, in which the addition result is "4". On the other hand, the image signal data after the movement is represented by a bit string of "000000000011", in which the addition result is "2". Comparison of these addition results provides a difference, and therefore determines the images which are to be deemed moving images.

In this case, when an arrangement is made so that the image signal data is transferred on a one-pixel basis in time series, real-time operation can be performed and a frame memory that preserves signal data of all the pixels is not necessary. With a conventional method that preserves the data in the frame memory, a memory capacity of 12 bits (1 bit×12 pixels) is necessary in the above example case. In the present invention, only the addition results and bits represented by binary digits preserved; therefore, only a 4-bit memory capacity is sufficient. Even when an addition result of a field of one-immediately-preceding screen is preserved, an 8-bit capacity is sufficient, in which case the size of circuits can be made smaller than that in the conventional arrangement. In the above, the example display screen of 4 horizontal pixels×3 vertical pixels has been used for purposes of description. However, as the number of the pixels of the screen is increased, differences regarding the necessary memory capacity between the conventional arrangement and the arrangement of the present invention is increased.

As described above, the present invention does not need to preserve digital signals equivalent to image signals for all the pixels of one screen; therefore it does not require a frame memory. Furthermore, as will be described later, the inventors confirmed that by comparison of addition results for signals of the immediately-preceding screen and current signals, the arrangement of the present invention can perform sufficiently accurate moving-image/still-image determination. Therefore, in the display apparatus of the present invention, a frame memory of a large capacity which consumes larger electric power is not used, so that increase of the manufacturing cost for the display apparatuses can be avoided, and the size of the display apparatus can be reduced. Furthermore, power consumption can be minimized because of drive-method switching.

According to another aspect of the present invention, there is provided a display apparatus that comprises a plurality of scanning lines and signal lines which are arranged in a matrix form; a scanning-line driving circuit to drive the scanning lines; a signal-line driving circuit to drive the signal lines; a moving-image/still-image determination circuit that has an adding means to add digital signals for one screen by regularly selecting pixels to be added from all pixels constituting image signals for one screen, receiving digital signals corresponding to the selected pixels, and adding the digital signals, has a comparing means to compare a result of addition of image signals for one screen, which has been provided by the adding means, to a result of addition of digital signals, which the adding means has provided by adding the digital signals corresponding to the regularly selected pixels to be added from all the pixels constituting the image signals for another screen which is adjacent to the earlier-stated one screen, uses a result of comparison by the comparing means to determine individual images provided by the image signals for the earlier-stated one-screen and the image signals for the later-stated another-screen to be moving images when the two addition results are different from each other and to determine the images to be still images when the two addition results are identical to each other, and outputs a determination signal corresponding to the moving image or the still image; and controls the scanning-line driving circuit and the signal-line driving circuit according to the determination signal.

In the former display apparatus, the adding means receives digital signals of the individual pixels on a pixel basis, which are equivalent to image signals of one screen, whereas in the latter display apparatus, the adding means regularly selects pixels to be added from among all the pixels of one screen and receives digital signals corresponding to the selected pixels; that is, pixels which would normally be reduced are added. This arrangement provides regularity to selection of pixels to be added, in which the moving-image/still-image determination can also be performed without problems. Furthermore, since selected pixels are added, storage capacity necessary for preservation of the addition results and the like can be smaller, and accordingly, size reduction of the display apparatus can be implemented by use of smaller circuits.

Furthermore, when a display apparatus is used for office equipment and the like, a case can be considered in which a background is uniform and invariable and a constant-shaped graphic moves. Images such as those described above are moving images. However, with the former display apparatus in which signals of all pixels of one screen are added, the moving images may be incorrectly determined as being still images. However, with the latter display apparatus, even when the constant-shaped graphic moves, since the pixels are reduced, addition results for signals for the immediately-preceding screen and the current signals are different, then the images are determined to be moving images. Therefore, for this type of graphic, the latter display apparatus provides higher determination accuracy.

As described above, the present invention has the moving-image/still-image determination circuit including the adding means, the comparing means, and the like, in which image signals of screens which are adjacent in time to each other are not compared to each other on a pixel basis, but addition results for all the pixels are instead compared to each other. Therefore, an arrangement can be made so that the image signals are transferred in time series on a pixel basis, in which it is no longer necessary to preserve the image signals at one time. This arrangement eliminates a large frame memory of a high-power consumption type, which has conventionally been used, allowing minimization of manufacturing-cost increase and size reduction for the display apparatus. The object of lower power consumption can be sufficiently achieved because of drive-method switching. Furthermore, the present invention provides sufficiently high accuracy for the moving-image/still-image determination and sufficiently high-quality images without defects such as lags and tailings. Furthermore, when pixels to be added are reduced, the moving-image/still-image determination accuracy can further be improved depending on the image pattern, and size reduction for circuits and other effects can be implemented.

DESCRIPTION OF THE PREFERRED EMBODIMENTS

Figure 1:
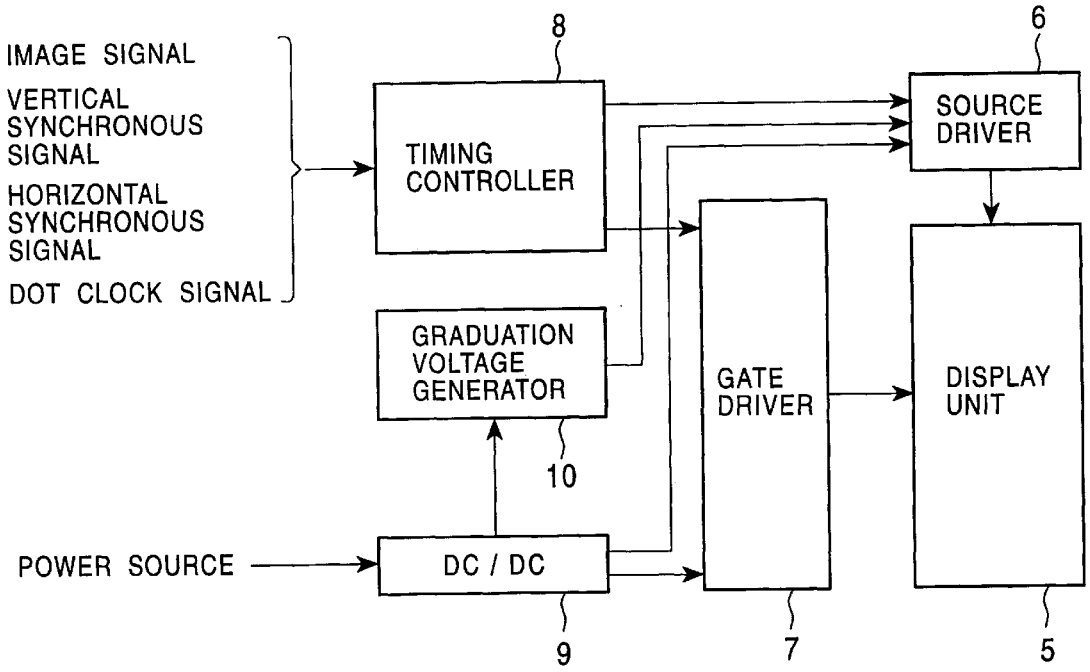
FIG. 1 is a schematic diagram showing an overall configuration of a display apparatus according to a first embodiment of the present invention.
Figure 2:
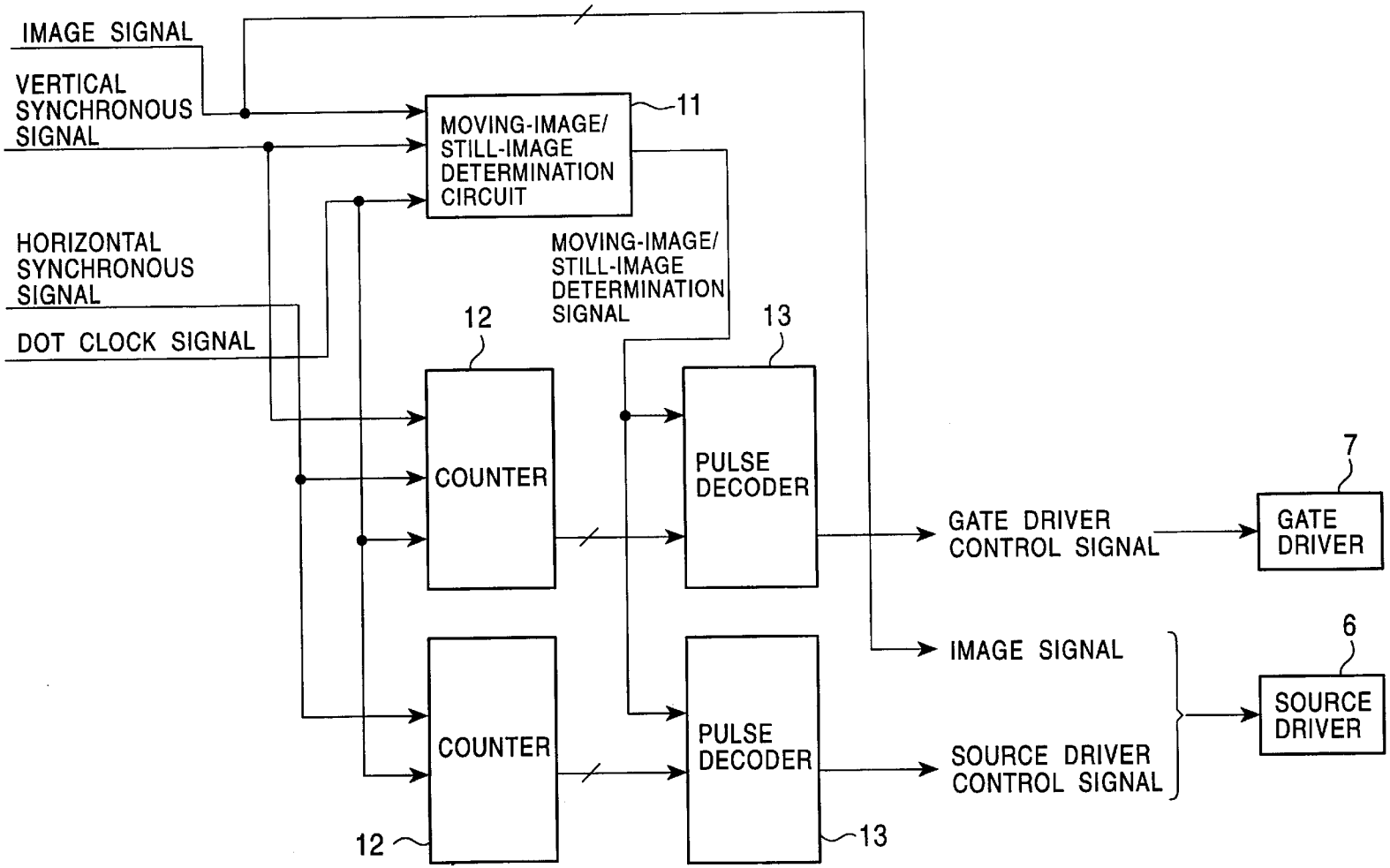
FIG. 2 is a schematic diagram showing an internal configuration of a timing controller of the display apparatus according to the first embodiment of the present invention.
Figure 3:
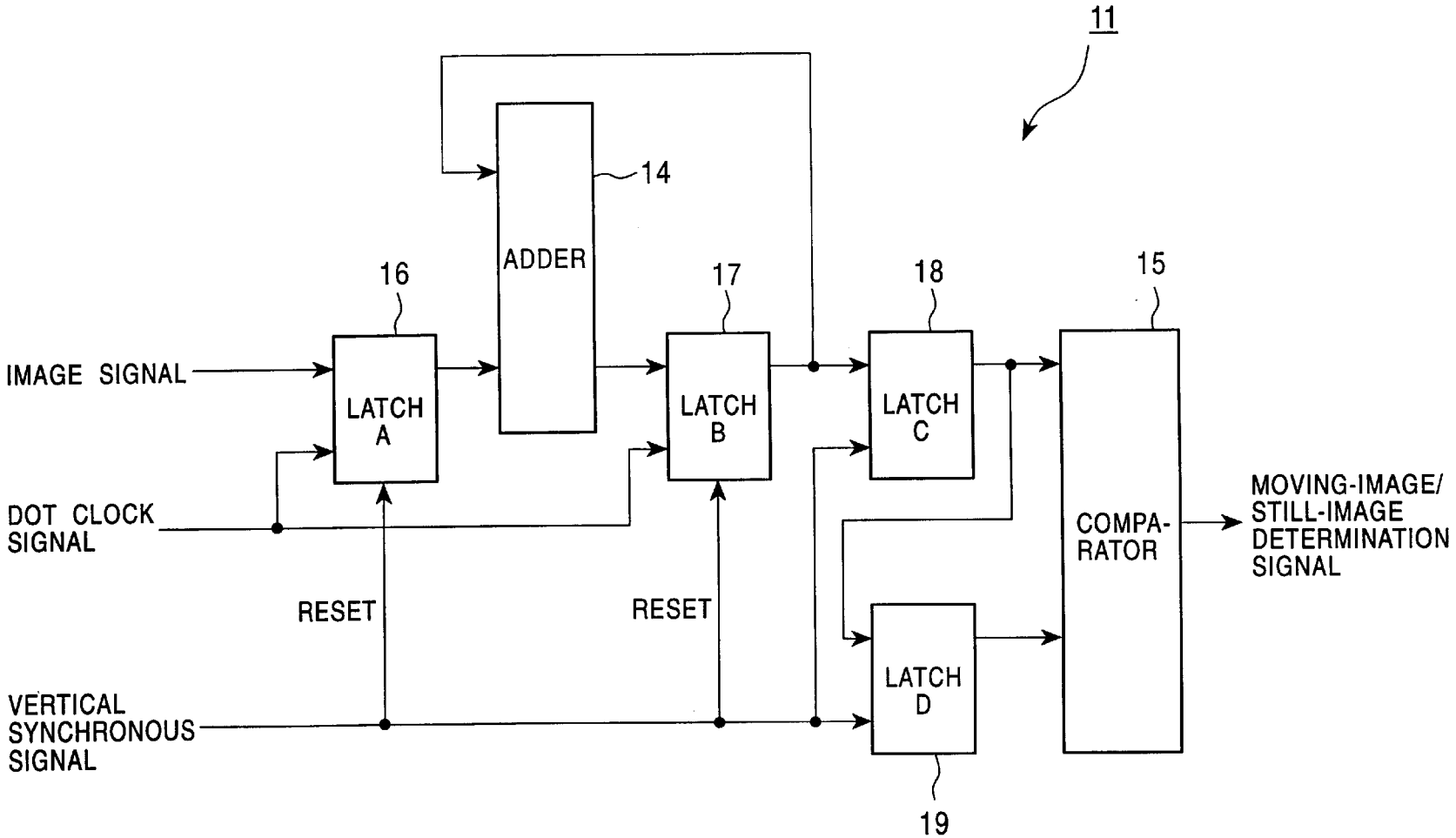
FIG. 3 is a schematic diagram showing a configuration of a moving-image/still-image determination circuit in the timing controller of the display apparatus according to the first embodiment of the present invention.

Referring to FIGS. 1 to 3, a description will be given of a first embodiment.

FIG. 1 shows an overall configuration of a liquid crystal display (LCD) apparatus according to the first embodiment of the present invention. The LCD apparatus shown in this figure is an example of active-matrix-type LCD apparatuses.

As shown in this figure, a large number of source lines (signal lines [not shown]) and gate lines (not shown) are arranged in a matrix form, by which a display section 5 is formed. Around the display section 5, a source driver (signal-line driving circuit) 6 and a gate driver (scanning-line driving circuit) 7 are arranged. Further, a timing controller 8, a direct-current-voltage converting circuit 9 (indicated as "DC/DC" in the figure), and a gradation voltage generator 10 are arranged. Image signals, vertical synchronous signals, horizontal synchronous signals, and dot clock signals are inputted to the timing controller 8, and a power-source voltage is inputted to the direct-current-voltage converting circuit 9.

FIG. 2 shows an internal configuration of the timing controller 8. The timing controller 8 comprises a moving-image/still-image determination circuit 11, which is a feature of the present invention. Furthermore, a counter 12 and a pulse decoder 13 are arranged individually at a source side and a gate side. The timing controller 8 is normally formed of a gate array such as a logic integrated circuit (IC). Image signals, vertical synchronous signals, horizontal synchronous signals, and dot clock signals are inputted to the moving-image/still-image determination circuit 11, moving-image/still-image determination signals outputted from the moving-image/still-image determination circuit 11 are inputted to the individual pulse decoders 13, and gate driver control signals and source driver control signals which are outputted from the pulse decoders 13 are inputted to the gate driver 7 and the source driver 6.

FIG. 3 shows a configuration of the moving-image/still-image determination circuit 11. This circuit 11 comprises an adder (an adding means) 14, a comparator (a comparing means) 15, and four latches 16 to 19. Either the adder 14 or the comparator 15 is formed of a standard logic circuit. The latch-A 16 is a circuit to retain image signals of one pixel and the bit width thereof is the same as that of the image signal. Each of the latch-B 17, the latch-C 18, and the latch-D 19, which are circuits to store addition results, basically has a bit width to store the largest possible value of the addition result; however, the bit width may be made smaller, depending upon required necessary determination accuracy. According to a reduced width, at least the circuit size can be reduced.

Hereinbelow, referring to FIG. 3, a description will be given of operation of the moving-image/still-image determination circuit 11.

First, image signals of one pixel which constitute image signals of one screen (thereafter, all the image signals are processed in a digital-signal form) are sequentially inputted to latch-A 16. At the next rising edge, the image signals are stored in the latch-A 16 and are concurrently outputted to the adder 14. At this time, in the adder 14, the newly transferred image signals are added to a result of addition of image signals in the last stage. The addition result is an output from the latch-B 17 and is initially 0 for one screen.

The addition processing is repeated for all image signals for one screen, and upon completion of the addition processings for one screen, data of the latch-B 17 is inputted to the latch-C 18, data of the latch-C 18 is inputted to the latch-D 19, and data stored in the latch-A 16 and the latch-B 17 is cleared, according to effects of the vertical synchronous signal. That is, an addition result for the screen immediately preceding the screen for which the addition result is stored in the latch-C 18 is stored in the latch-D 19.

Next, the addition results in the latch-C 18 and the latch-D 19 are compared by the comparator 15. If the addition results are found to be different from each other, images provided by image signals for the immediately-preceding screen and current image signals are determined to be moving images; if the addition results are the same, the images are determined to be still images. Based on this determination processing, the moving-image/still-image determination signal corresponding to either one of the moving image and the still image is outputted. The moving-image/still-image determination signal is a one-bit signal, and the signal is "0" for the still image and is "1" for the moving image in a standard configuration in which the comparator 15 uses an exclusive-OR.

As shown in FIG. 2, the moving-image/still-image determination signal outputted from the moving-image/still-image determination circuit 11 is inputted to the pulse decoder 13. From this pulse decoder 13, the gate driver control signal is outputted to the gate driver 7 and the source driver control signal is outputted to the source driver 6. By the gate driver control signal and source driver control signal, the gate driver 7 and the source driver 6 are controlled so as to perform switching between two different driving methods, depending on the image type, that is, the moving image or the still image. A progressive driving method is switched on for the moving image to sequentially scan all scanning lines in one frame, and an interlace-driving method is switched on for the still image to separate one frame into plural fields in order to perform interlaced scanning for each of the fields.

In the display apparatus according to this embodiment of the present invention, the moving-image/still-image determination circuit 11 is formed only of very simple logic circuits, such as the adder 14, the comparator 15, and the latches 16, 17, 18, and 19, because it preserves only one-pixel data and operation results. In this arrangement, since image signal data is processed per pixel in time-series; image signals of all pixels are not required to be preserved. Therefore, a frame memory of a large capacity which consumes greater electric power is not required, so that increase of the manufacturing cost for the display apparatuses can be avoided and the size of the display apparatuses can also be reduced. Furthermore, power consumption can be minimized because of drive-method switching.

Furthermore, accuracy of moving-image/still-image determination in this embodiment is determined solely according to the addition result, in which, in terms of probability, a series of screens having different image data strings, i.e., moving images, may be determined to be still images because the addition results may match by coincidence. Therefore, the inventors actually used video signals of an NTSC television or the like to this embodiment for 20 minutes, measured moving-image/still-image determination signals outputted, and checked results of the moving-image/still-image determination. As a result, probability of incorrect determination made for moving images to be still images was $2.3\times10^{-7}$ or lower. In this way, for the video signals of such televisions, the moving-image/still-image determination circuit 11 of the display apparatus of the present invention was confirmed to be an effective code generator which is specific to image data signals of one screen. Images obtained in the experiment were also confirmed to be of high quality with no lags nor tailings.

Hereinbelow, referring to FIGS. 4 to 7, a second embodiment will be described.

An overall configuration of the second embodiment is the same as that of the first embodiment. The only difference is that pixels to be subjected to the addition processing are selectively reduced from one-screen pixels. Therefore, the overall configuration is not described here.

Figure 5:
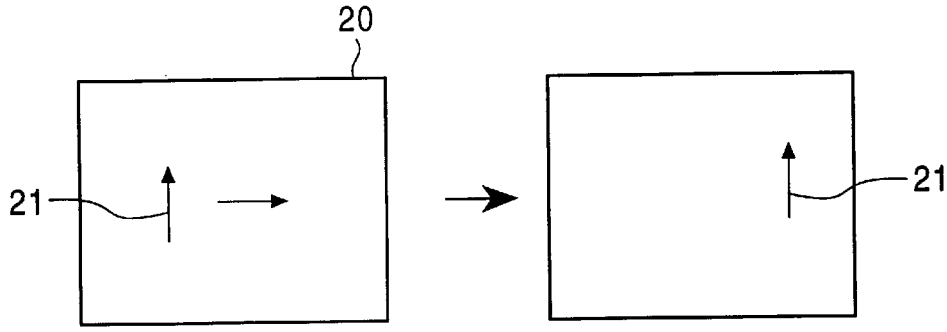
FIG. 5 is a view showing examples of graphic patterns of moving images.

In a display apparatus used for office equipment and the like, as an image when a cursor 21 is moved in a screen 20 shown in FIG. 5, for example, images in which the background is uniform and invariable and a constant-shaped graphic moves can be considered. Images such as those described above are moving images. However, with the display apparatus of the first embodiment in which signals of all pixels of one screen are added, addition results can match by coincidence, and the moving images may be determined to be still images.

Figure 4:
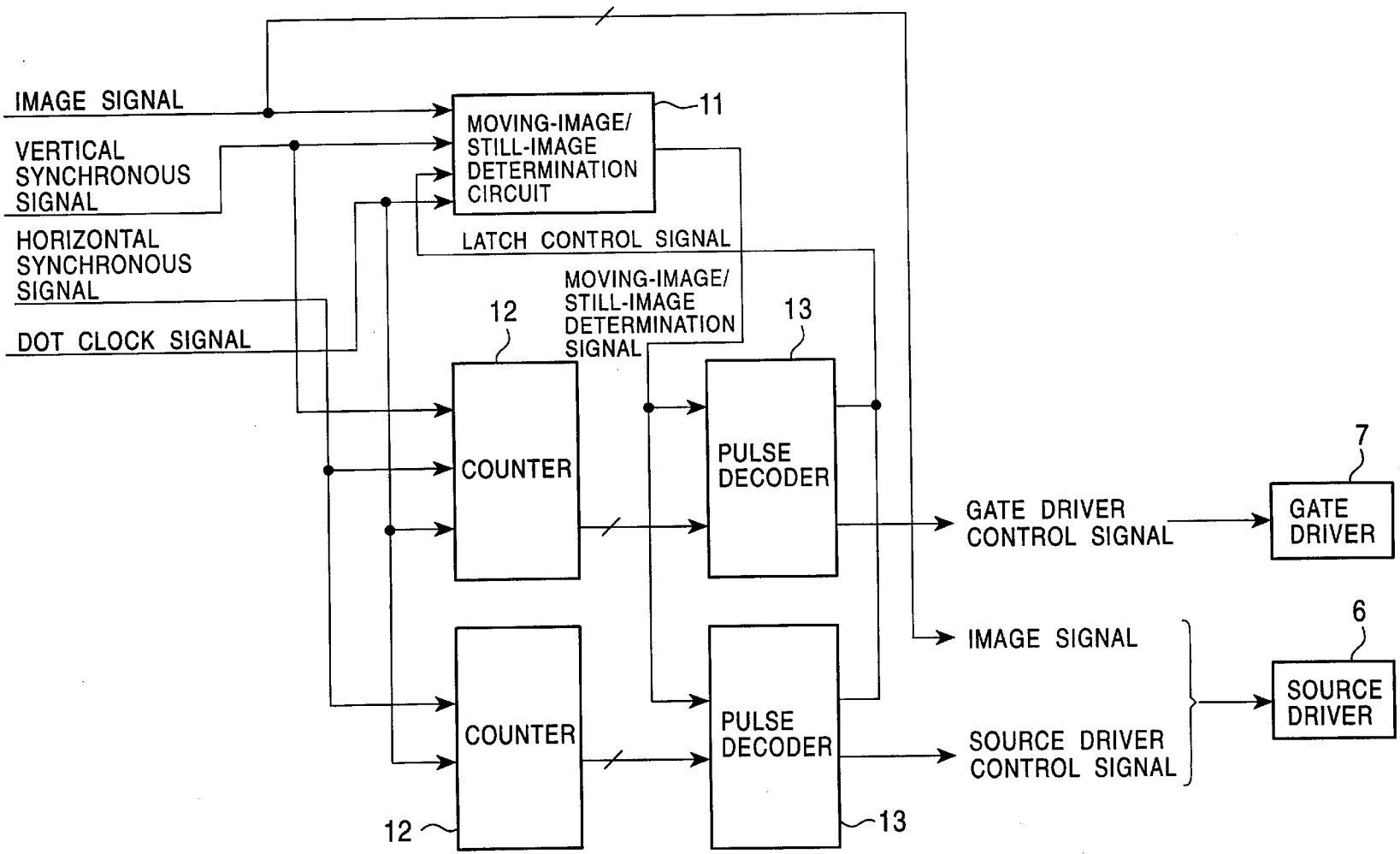
FIG. 4 is a schematic diagram showing an internal configuration of a timing controller of a display apparatus according to a second embodiment of the present invention.

In consideration of the above, the display apparatus of this second embodiment is arranged such that pixels to be added are regularly selected in the moving-image/still-image determination circuit from all pixels constituting one-screen image signals, and only digital signals corresponding to the selected pixels are added. In particular, as shown in FIG. 4, in the moving-image/still-image determination circuit 11, the addition processing can be selectively performed by addition of a signal (referred to as "latch control signal" in FIG. 4) as an input, which controls whether or not latching of the inputted image signal is performed. That is, only when this latch control signal is active, an input of individual latches at a dot-clock rising edge is allowed to be held. This latch control signal can be created in the pulse decoder 13.

Figure 6:
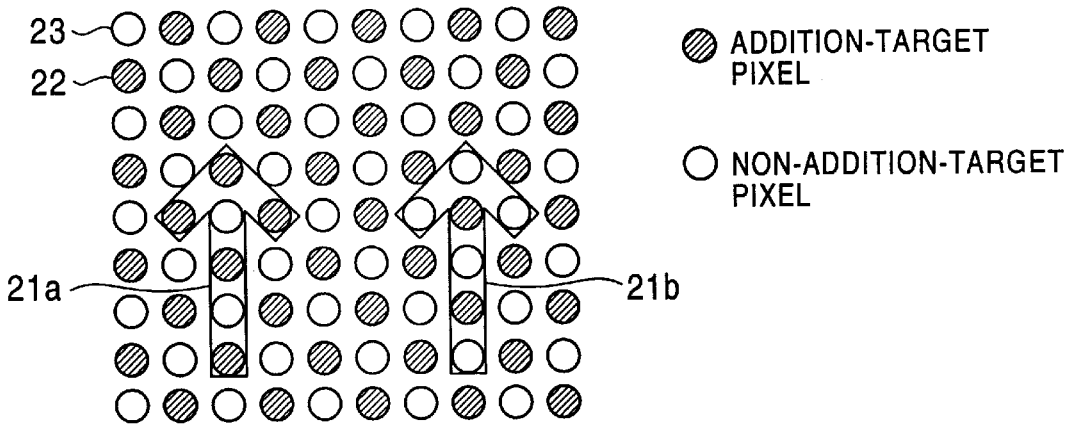
FIG. 6 is an example of a reduced pattern of addition-target pixels in the display apparatus according to the second embodiment of the present invention.
Figure 7:
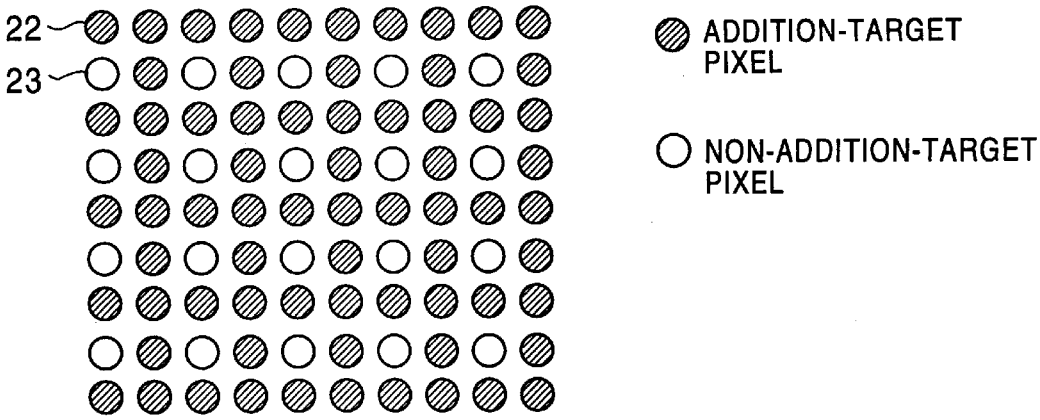
FIG. 7 is an example of another reduced pattern.
Figure 8A:
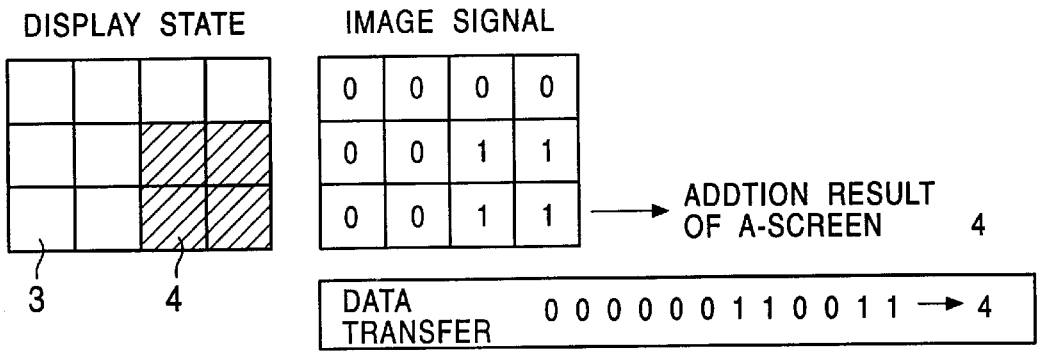
FIG. 8 is illustrative of a principle of moving-image/still-image determination according to the present invention.
Figure 8B:
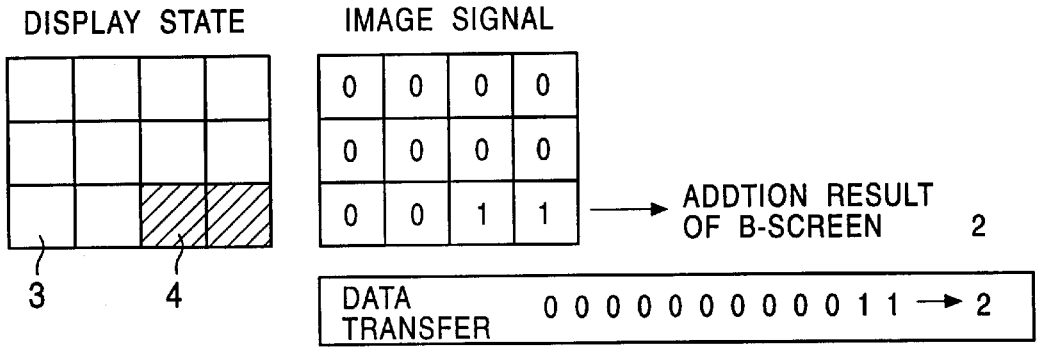
Figure 9:
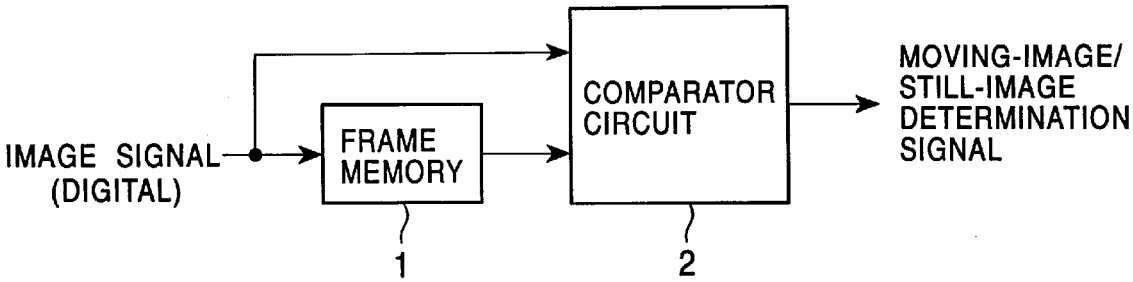
FIG. 9 is a schematic diagram illustrative of a moving-image/still-image determination method of a conventional display apparatus.

FIGS. 6 and 7 show examples of patterns to regularly select pixels targeted for addition. The hatched circles represent addition-target pixels 22, and the non-hatched circles represent non-addition-target pixels 23. FIG. 6 shows a checkered pattern in which the addition-target pixels 22 are alternately arranged according to odd-numbered and even-numbered scanning lines. FIG. 7 shows a lattice-like pattern in which the addition-target pixels 22 are arranged.

Hereinbelow, a principle of the moving-image/still-image determination when a cursor is moved is described, referring to the pattern example in FIG. 6. As shown in FIG. 6, it is assumed that schematically, a cursor 21*a* is an arrow made of seven pixels and this cursor 21*a* moves from left to right in the figure (the symbol 21*b* represents a cursor after the movement). It is also assumed that all the pixels in the background are white ("0" digital signals), and only seven pixels of the cursor 21*a* which are black ("1" digital signals) form the arrow. In this case, in a position where before cursor is moved, five of seven pixels forming the cursor 21*a* are addition-target pixels. Therefore, although seven "1" signals actually exist, the addition result is "5". In the position where after the cursor is moved, since the number of the addition-target pixels is only two, the addition result is only "2". In this way, the addition results are different depending upon the state before and after the cursor is moved, from which the cursor-movement image is determined to be a moving image.

As described above, in the display apparatus of this embodiment in which pixels are regularly selected from all the pixels and signals of the selected pixels are added, although a constant graphic is moved, the graphic is determined to be a moving image. This is because pixels are reduced so that the addition results are different between the case of signals for the immediately preceding screen and the case of current signals. Accordingly, for determination of this type of image, accuracy of the determination by the display apparatus of the present invention is high and appropriate. Furthermore, the addition result is smaller than that performed in the first embodiment. That is, because the data that the latch must preserve is smaller, the circuit size can be made smaller.

Although the invention has been described through its preferred forms, the engineering scope of the invention is not restricted to the embodiments and various changes and modifications may be applied thereto without departing from the scope of the invention. For example, regarding the arrangement for the latches related to the adder and the comparator in the moving-image/still-image determination circuit, arrangements such as those in the embodiments described above may be modified as necessary. Furthermore, the examples of the patterns to regularly select the addition-target pixels, as shown in FIGS. 6 and 7, for the second embodiment, are not restricted to those described, and various other patterns may be used. Furthermore, although one pixel is represented by one circle or one hatched circle, plural pixels can be corresponded to the one circle in this pattern.

What is claimed is:

1. A display apparatus comprising:

a plurality of scanning lines and signal lines arranged in a matrix;

a scanning-line driving circuit to drive the scanning lines;

a signal-line driving circuit to drive the signal lines;

a moving-image/still-image determination circuit having adding means to add digital signals of pixels constituting image signals for a screen by receiving the digital signals on a pixel basis, having comparing means to compare a result of addition of image signals for one screen, which has been provided by said adding means, to a result of addition of digital signals constituting image signals for another screen being adjacent in time to the earlier-stated one screen, using a result of comparison by said comparing means to determine individual images provided by the image signals and by the image signals for the earlier-stated one screen and later-stated another-screen to be moving images when the two addition results are different from each other and to determine the images to be still images when the two addition results are identical to each other, and outputting a determination signal corresponding to the moving image or the still image; and controlling said scanning-line driving circuit and said signal-line driving circuit according to the determination signal.

2. A display apparatus comprising a plurality of scanning lines and signal lines arranged in a matrix;

a scanning-line driving circuit to drive the scanning lines;

a signal-line driving circuit to drive the signal lines;

a moving-image/still-image determination circuit having adding means to add digital signals for one screen by regularly selecting pixels to be added from all pixels constituting image signals for one screen, receiving digital signals corresponding to the selected pixels, and adding the digital signals, having comparing means to compare a result of addition of image signals for one screen, which has been provided by said adding means, to a result of addition of digital signals, which said adding means has provided by adding the digital signals corresponding to the regularly selected pixels to be added from all the pixels constituting the image signals for another screen being adjacent to the earlier-stated one screen, using a result of comparison by said comparing means to determine individual images provided by the image signals for the earlier-stated one-screen and the image signals for the later-stated another-screen to be moving images when the two addition results are different from each other and to determine the images to be still images when the two addition results are identical to each other, and outputting a determination signal corresponding to the moving image or the still image;

and controlling said scanning-line driving circuit and said signal-line driving circuit according to the determination signal.

3. A driving method for driving said display apparatus according to claim 1, wherein when the images are determined to be moving images, all the scanning lines are sequentially scanned in one frame; and when the images are determined to be still images, one frame is separated into plural fields, and interlaced scanning is performed for each predetermined field.

4. A driving method for driving said display apparatus according to claim 2, wherein when the images are determined to be moving images, all the scanning lines are sequentially scanned in one frame; and when the images are determined to be still images, one frame is separated into plural fields, and interlaced scanning is performed for each predetermined field.

* * * * *